US006043209A

United States Patent [19]

Micciche et al.

[11] Patent Number: 6,043,209

[45] Date of Patent: Mar. 28, 2000

[54] STABLE COMPOSITIONS FOR REMOVING STAINS FROM FABRICS AND CARPETS AND INHIBITING THE RESOILING OF SAME

[75] Inventors: Robert P Micciche, Somerset; Ann Marie Lynch, Glen Rock; Uma Tripathi, Gladstone, all of N.J.

[73] Assignee: Playtex Products, Inc., Westport, Conn.

[21] Appl. No.: 09/003,272

[22] Filed: Jan. 6, 1998

[51] Int. Cl.[7] ..... C11D 1/83; C11D 3/37; C11D 3/395; C11D 3/44

[52] U.S. Cl. ..... 510/280; 510/278; 510/299; 510/303; 510/318; 510/337; 510/351; 510/352; 510/356; 510/357; 510/361; 510/369; 510/372; 510/477; 510/528

[58] Field of Search ..... 510/278, 280, 510/299, 303, 318, 337, 351, 352, 356, 357, 361, 369, 372, 477, 528

[56] References Cited

U.S. PATENT DOCUMENTS

| | | | |
|---|---|---|---|
| 491,413 | 2/1893 | Ehman . | |
| 3,462,294 | 8/1969 | Thomas | 442/82 |
| 3,607,760 | 9/1971 | McIntyre | 510/280 |
| 3,664,962 | 5/1972 | Kelley et al. | 510/174 |
| 3,779,929 | 12/1973 | Abler et al. | 510/279 |
| 3,844,760 | 10/1974 | Nelson | 504/152 |
| 3,954,660 | 5/1976 | Kennedy et al. | 516/200 |
| 4,124,542 | 11/1978 | Devine | 510/280 |
| 4,166,794 | 9/1979 | Grey | 510/518 |
| 4,219,333 | 8/1980 | Harris | 8/137 |
| 4,295,845 | 10/1981 | Sepulveda et al. | 8/139.1 |
| 4,311,618 | 1/1982 | Schäfer Burkhand | 510/283 |
| 4,363,756 | 12/1982 | Sepulveda et al. | 510/283 |
| 4,437,928 | 3/1984 | Wong | 216/106 |
| 4,457,857 | 7/1984 | Sepulveda et al. | 510/283 |
| 4,490,271 | 12/1984 | Spadini et al. | 510/352 |
| 4,497,725 | 2/1985 | Smith et al. | 8/137 |
| 4,525,291 | 6/1985 | Smith et al. | 510/303 |
| 4,530,781 | 7/1985 | Gipp | 510/284 |
| 4,540,505 | 9/1985 | Frazier | 510/384 |
| 4,561,991 | 12/1985 | Herbots et al. | 510/281 |
| 4,595,527 | 6/1986 | Gipp | 510/284 |
| 4,698,170 | 10/1987 | Le Coent | 508/392 |
| 4,741,863 | 5/1988 | Yamamoto et al. | 510/245 |
| 4,828,569 | 5/1989 | Heath et al. | 8/137 |
| 4,834,900 | 5/1989 | Soldanski et al. | 8/142 |
| 4,844,952 | 7/1989 | Korenkiewicz et al. | 427/258 |
| 4,857,392 | 8/1989 | Kirjanov et al. | 442/94 |
| 4,861,516 | 8/1989 | Kurzendoerfer et al. | 510/284 |
| 4,877,556 | 10/1989 | Wilsberg et al. | 510/284 |
| 4,906,303 | 3/1990 | Freij | 134/38 |
| 4,937,123 | 6/1990 | Chang et al. | 428/96 |
| 4,954,286 | 9/1990 | Sepulveda et al. | 510/284 |
| 5,001,004 | 3/1991 | Fitzgerald et al. | 442/93 |
| 5,002,684 | 3/1991 | Beck et al. | 8/102 |
| 5,084,306 | 1/1992 | McLellan et al. | 427/393.4 |
| 5,085,795 | 2/1992 | Narayanan et al. | 510/284 |
| 5,164,117 | 11/1992 | Sauer et al. | 510/536 |
| 5,186,856 | 2/1993 | Holland | 510/284 |
| 5,205,960 | 4/1993 | Kistopeit et al. | 510/284 |
| 5,221,496 | 6/1993 | Holland | 510/284 |
| 5,230,811 | 7/1993 | Shimotomai et al. | 210/755 |
| 5,238,587 | 8/1993 | Smith et al. | 510/277 |
| 5,252,243 | 10/1993 | Minns | 8/111 |
| 5,269,958 | 12/1993 | de Jager | 510/281 |
| 5,284,597 | 2/1994 | Rees | 510/280 |
| 5,334,331 | 8/1994 | Fusiak | 510/174 |
| 5,374,362 | 12/1994 | McFarland | 106/2 |
| 5,374,631 | 12/1994 | Oppong et al. | 514/241 |
| 5,387,373 | 2/1995 | Naik | 510/403 |
| 5,399,285 | 3/1995 | Kanuen | 510/427 |
| 5,409,629 | 4/1995 | Shulman et al. | 510/337 |
| 5,439,610 | 8/1995 | Ryan et al. | 510/280 |
| 5,486,315 | 1/1996 | Tseng | 510/480 |
| 5,490,948 | 2/1996 | Klier et al. | 510/283 |
| 5,492,540 | 2/1996 | Leifheit et al. | 8/111 |
| 5,503,778 | 4/1996 | Liu et al. | 134/6 |
| 5,531,927 | 7/1996 | Peters | 510/281 |
| 5,534,165 | 7/1996 | Pilosof et al. | 252/8.91 |
| 5,534,167 | 7/1996 | Billman | 510/280 |
| 5,534,200 | 7/1996 | Erilli et al. | 510/396 |
| 5,538,662 | 7/1996 | Klier et al. | 510/284 |
| 5,565,420 | 10/1996 | Stearns | 510/358 |
| 5,575,948 | 11/1996 | Petchul et al. | 252/186.28 |
| 5,591,236 | 1/1997 | Roetker | 8/137 |
| 5,634,947 | 6/1997 | Kazama | 8/137 |
| 5,712,240 | 1/1998 | Tyerech et al. | 510/424 |
| 5,728,669 | 3/1998 | Tyerech | 510/280 |
| 5,861,365 | 1/1999 | Colurciello, Jr. et al. | 510/278 |

OTHER PUBLICATIONS

McCutcheon's Emulsifiers & Detergents, International Edition, vol. 1; The Manufacturing Confectioner Publishing Co., 1995. pp. 85–86, 231–232, 1995.

"Organic Chemisty" T.W.Graham Solomons, University of South Florida, 1984, pp. 354–357.

"Metal–Catalyzed Oxidations of Organic Compounds" Roger A. Sheldon and Jay K. Kochi, 1981, 33–38.

*Primary Examiner*—Yogendra Gupta
*Assistant Examiner*—Gregory R. DelCotto
*Attorney, Agent, or Firm*—Ohlandt, Greeley, Ruggiero & Perle

[57] ABSTRACT

There is provided an aqueous composition for cleaning fabrics and carpets and inhibiting the resoiling of fabric and carpets. The composition includes a water miscible organic solvent, a peroxygen compound, a surfactant, a polymeric or copolymeric soil resist, and a fluorinated hydrocarbon soil resist. The solvent is selected from isopropanol, propylene glycol methyl ether, dipropylene glycol methyl ether, or mixtures of two or more thereof. Compositions formed with these solvents and both soil resists are particularly stable and non-turbid.

23 Claims, No Drawings

STABLE COMPOSITIONS FOR REMOVING STAINS FROM FABRICS AND CARPETS AND INHIBITING THE RESOILING OF SAME

BACKGROUND OF THE INVENTION

I. Field of the Invention

The present invention relates to aqueous compositions capable of removing stains from fabrics and carpets. Specifically, the present invention relates to aqueous compositions for removing oil and grease stains from fabrics and carpets, and inhibiting the resoiling of the fabrics and carpets+–. Such compositions contain selected one or more water miscible solvents, peroxygen compounds and surfactants in combination with additives that inhibit resoiling. More specifically, the present invention relates to such compositions that exhibit superior solution stability and reduced turbidity.

II. Description of the Prior Art

Fabric and carpet fibers are easily stained upon contact with oils and greases. Such stains are conventionally removed by compositions containing combinations of organic solvents and cleansing surfactants that lift and remove oily stains from the fabric. Commonly, stain remover compositions are formulated to further contain an active oxygen-containing compound (more commonly referred to as a peroxygen compound), such as hydrogen peroxide. Peroxygen compounds oxidize and decolorize stains formed by contact with organic materials and complement the actions of the solvents and surfactants.

Fabric cleaning compositions also commonly contain one or more anti-resoiling agents, commonly referred to as soil resists. Soil resists prevent or impede the resoiling of the fabric after cleaning. One type of soil resist, an olefinic/acrylate polymer, is described in U.S. Pat. No. 5,534,167 to Billman. See also U.S. Pat. No. 5,001,004 to Fitzgerald et al. In surfactant-containing cleaning compositions, a polymeric or copolymeric soil resist embrittles the surfactants upon drying. Embrittlement prevents the surfactants from drying into a waxy, tacky layer that remains on the fabric after removal of the cleaning composition. If left on the fabric, such a waxy, tacky layer will attract and hold dirt on the surface of the cleaned fabric.

A second class of soil resist includes certain fluorinated hydrocarbons. Such fluorinated hydrocarbons are often sprayed onto new fabrics, particularly carpet fibers. However, use and cleaning of the fabric or carpet degrades the effects of the fluorinated hydrocarbon soil resist. Therefore, periodic re-application of the soil resist is necessary. Fluorinated hydrocarbon soil resists and the use thereof in fabric cleaning compositions are described, for example, in U.S. Pat. No. 5,439,610 to Ryan et al. and the Billman patent, supra. Unlike a polymeric or copolymeric soil resist, a fluorinated hydrocarbon soil resist provides resoiling protection by coating the fibers of the fabric or carpet to form a barrier layer that physically prevents dirt and stain-causing materials from adhering to and staining the fibers.

Because of the different manners in which they inhibit resoiling, the two types of soil resists are preferably used in combination. The combined use of a polymeric or copolymeric soil resist and a fluorinated hydrocarbon soil resist provides maximum anti-resoiling properties. However, the combined use thereof is not always possible due to interactions between the soil resists and interactions between the soil resists and the solvent. More specifically, not every polymeric or copolymeric soil resist is compatible with all water miscible organic solvents. Also, many solvents with which the polymeric or copolymeric soil resist can be used are not compatible with all fluorinated hydrocarbon soil resists. This incompatibility prevents the formation of stable solutions containing both types of soil resists and can result in a product having an unacceptable level of turbidity. This problem of incompatibility between the solvents and soil resists is exacerbated to a large degree by the presence of the peroxygen compound.

SUMMARY OF THE INVENTION

It is an object of the present invention to provide an aqueous stain-removing composition for removing grease and oil-type stains from fabrics and carpets.

It is also an object of the present invention to provide such a composition that will further prevent or inhibit the resoiling of the cleaned fabrics and carpet.

It is another object of the present invention to provide such a composition that includes a water miscible organic solvent, a surfactant, a peroxygen compound, a polymeric or copolymeric soil resist and a fluorinated hydrocarbon soil resist.

It is a still further object of the present invention to provide such a composition in which all the ingredients are selected such that all are compatible and form a stable, non-turbid solution.

To accomplish the foregoing objects and advantages, the present invention, in brief summary, is a clear, stable, stain removing solution comprising:

a water miscible organic solvent selected from the group consisting of isopropanol, propylene glycol methyl ether (methoxyisopropanol) and dipropylene glycol methyl ether;

a peroxygen compound;

a surfactant;

a polymeric or copolymeric soil resist; and a fluorinated hydrocarbon soil resist.

DETAILED DESCRIPTION OF THE PREFERRED EMBODIMENTS

The compositions of the present invention are aqueous cleaning compositions. Such compositions are stain removing compositions containing one or more water miscible organic solvents, one or more peroxygen compounds, one or more surfactants, one or more polymeric or copolymeric soil resists, and one or more fluorinated hydrocarbon soil resists. Optionally, the composition may contain additional components, such as a preservative, a stabilizer/pH buffer, and a fragrance.

It has been found that by proper selection of the solvent, both the polymeric or copolymeric soil resist and the fluorinated hydrocarbon soil resist can be incorporated to form a stable, non-turbid solution, in the presence of the peroxygen compound. Such stability provides for more latitude in formulating the cleaning composition, allows for the use of reduced amounts of a stabilizer compound (chelating agent), and results in a superior and stable product.

The compositions of the present invention include from about 0.1 to about 5.0 wt. %, preferably from about 1.0 to about 3.0 wt. %, more preferably from about 1.5 to about 2.5 wt. %, of a water-miscible organic solvent. The water-miscible organic solvent can be isopropanol, propylene glycol methyl ether, dipropylene glycol methyl ether, or mixtures of two or more thereof. These water-soluble organic solvents, used either individually or in combination, will form stable solutions with the hydrogen peroxide, surfactant, polymeric or copolymeric soil resist, and fluorinated hydrocarbon soil resist. Another solvent that would be expected to provide similar results is ethylene glycol n-hexylether (EGHE), sold by Union Carbide under the tradename HEXYL CELLOSOLVE. However, this solvent does not form as stable a solution when used to form an otherwise identical composition.

The compositions of the present invention include from about 0.2 to about 6.0 wt. %, preferably from about 1.0 to about 4.0 wt. %, and most preferably from about 2.5 to about 3.5 wt. %, of a peroxygen compound. Peroxygen compounds suitable for use in the present invention include hydrogen peroxide and T-butyl hydroperoxide. The use of hydrogen peroxide is preferred.

The total amount of surfactant in the compositions of the present invention is from about 0.2 to about 6.0 wt. %, preferably from about 0.5 to about 3.0 wt. %, and most preferably from about 1.0 to about 1.5 wt. %. Surfactants suitable for use in the present compositions include anionic, cationic, nonionic and zwitterionic surfactants, which are all well known in the art. Preferably, the compositions of the present invention include anionic or nonionic surfactants. Most preferably, the compositions include a mixture of anionic and nonionic surfactants (excluding the fluorinated hydrocarbon soil resists, some of which may also be classified as an anionic, nonionic or cationic surfactant).

Suitable anionic surfactants include, for example, alcohol sulfates and sulfonates, alcohol phosphates and phosphonates, alkyl sulfonates, alkylaryl sulfonates, alkali metal or ammonium salts of fatty acids, sulfonated amines, sulfonated amides, and mixtures thereof. A more complete list of anionic surfactants is provided in McCutcheon's, Volume 1, Emulsifiers and Detergents, pp 280–283 (1997), which is incorporated herein by reference. Preferred anionic surfactants for use in the compositions of the present invention include sodium lauryl sulfate and sodium lauroyl sarcosinate.

Nonionic surfactants suitable for use in the compositions of the present invention include, for example, ethoxylated and propoxylated alcohols, ethylene oxide/propylene oxide copolymers, ethoxylated and propoxylated fatty acids and ethoxylated and propoxylated alkyl phenols. A more complete list of nonionic surfactants is also provided in McCutcheon's, supra, pp 283–289. Particularly good results have been achieved with lauramine oxide and $C_{11}$–$C_{15}$ Pareth 7 (a $C_{11}$–$C_{15}$ secondary alcohol ethoxylate sold by Union Carbide under the tradename TERGITOL 15-S-7).

The compositions of the present invention further include from about 0.1 to about 4.0 wt. %, preferably from about 0.2 to about 2.0 wt. %, most preferably from about 0.3 to about 0.9 wt. %, of a polymeric or copolymeric soil resist. Suitable polymeric or copolymeric soil resists include polymers derived from monomers of acrylic acid, methacrylic acid, methacrylate, methyl-methacrylate, ethyl acrylate and maleic acid, as well as copolymers derived from the above monomers and olefin. The acrylic acid portion of the polymeric or copolymeric soil resist can be in the form of free acid, or a water soluble salt of acrylic acid (e.g., alkali metal salts, ammonium salts and amine salts). Preferably, the polymeric or copolymeric soil resist is a mixture of acrylate polymers having a wide range of molecular weights. The preferred polymeric or copolymeric soil resist is sold by Interpolymer Corporation under the trade name SYNTRAN DX6-125. The SYNTRAN DX6-125 soil resist is a water-based dispersion containing about 20 wt. % of a copolymer of methacrylic acid, methylmethacrylate and styrene, having a number average molecular weight of about 6000 to about 8000. This dispersion has a specific gravity of about 1.055, a pH at 22° C. of about 8, and a viscosity at 22° C. of about 1000 cps (Brookfield) maximum.

The compositions of the present invention contain the fluorocarbon component of a fluorinated hydrocarbon soil resist in an amount from about 0.001 wt. % to about 2.0 wt. %, preferably from about 0.01 to about 1.0 wt. %, most preferably from about 0.01 wt. % to about 0.6 wt. %. The fluorinated hydrocarbon soil resists useful in the compositions of the present invention are characterized as perfluoroalkyl compounds and are available commercially from a number of manufacturers. E.I. DuPont de Nemours & Co. markets one line of perfluoroalkyl soil resists under the tradename ZONYL. Fluorinated hydrocarbon soil resists are also sold by 3M Corp. under the tradename FLOURAD. A particularly suitable perfluoroalkyl soil resist is sold by E.I. DuPont de Nemours & Co. under the designation ZONYL 5180. The ZONYL 5180 fluorinated hydrocarbon soil resist contains about 70 wt. % to about 75 wt. % water, about 1 wt. % to about 10 wt. % fluorocarbon (active), and about 10 wt. % to about 20 wt. % polymethylmethacrylate. The ZONYL 5180 fluorinated hydrocarbon soil resist is anionic in nature, and has a density about 1.08 g/cc, and a pH about 3.0 to about 5.5.

The pH of each composition of the present invention is from about 5.0 to about 8.0 and preferably from about 5.5 to about 7.0. The pH can be adjusted within this range by the addition of a stabilizer/pH controller. Basically, this stabilizer/pH controller stabilizes the composition and controls the pH of the composition. The stabilizer/pH controller is a chelating agent/acidifying agent. The stabilizer/pH controller is present in an amount from about 0.30 wt % to about 0.12 wt % to obtain a pH from about 5.5 to about 7.0, respectively.

The compositions of the present invention can also contain additional components commonly used in cleaning solutions. Such additional components include, but are not limited to, a preservative and a fragrance.

EXAMPLE 1

A cleaning composition of the present invention was formed with the following ingredients in amounts expressed as percents of the total weight of the composition:

| Ingredient | Type of Ingredient | Wt. % Active |
|---|---|---|
| Water | carrier | 92.87 |
| Hydrogen Peroxide | oxidizing agent | 3.00 |
| Acrylate Copolymer | polymeric soil resist | 0.60 |
| Sodium Lauryl Sulfate | surfactant | 0.60 |
| Propylene Glycol Methyl Ether | organic solvent | 1.00 |
| Dipropylene Glycol Methyl Ether | organic solvent | 1.00 |
| Sodium Lauroyl Sarcosinate | surfactant | 0.23 |
| Lauramine Oxide | surfactant | 0.07 |
| C11–15 Pareth 7 | surfactant | 0.25 |
| DEQUEST 2010* | stabilizer/pH controller | 0.12 |
| Fragrance | | 0.15 |
| Zoner 5180 | fluorinated soil resist | 0.03 |
| SURCIDE-D | preservative | 0.08 |

*1-hydroxyethylidene-1,1-diphosphonic acid
**hexahydro-1,3,5-tris(2-hydroxyethyl)-s-triazine The following four "comparative" examples illustrate compositions that lack one or more ingredients of the compositions of the present invention. These examples when compared to Example 1 emphasize the unexpected results achieved by the composition of Example 1.

COMPARATIVE EXAMPLE 2

Comparative Example 2 was identical to Example 1, except that (a) 2 wt. % HEXYL CELLOSOLVE was used in place of the dipropylene glycol methyl ether (1%)/propylene glycol methyl ether (1%) solvent, and (b) no acrylate copolymer soil resist was used (the sample contained the fluorinated hydrocarbon soil resist).

COMPARATIVE EXAMPLE 3

Comparative Example 3 was identical to Example 1, except that 2 wt. % HEXYL CELLOSOLVE was used in place of the dipropylene glycol methyl ether (1%)/propylene glycol methyl ether (1%) as the solvent (contained both the acrylate copolymer soil resist and the fluorinated hydrocarbon soil resist).

The turbidity of the above samples was measured as a % transmission at 800 nm, 600 nm and 400 nm, using a Perkin Elmer UV/VIS Spectrometer Lambda 14P. Deionized water (100% transmission) and a solid beam (0% transmission) were used as controls. In addition, a "borderline solution" was tested. The borderline solution was formulated to display the minimal acceptable transmission at each wavelength, for purposes of comparison. The results obtained are shown in Table 1.

TABLE 1

| | Wavelength | | |
|---|---|---|---|
| | 800 nm | 600 nm | 400 nm |
| Deionized Water | 100 | 100 | 100 |
| Example 1 | 99.7 | 98.6 | 93.5 |
| Comp. Example 2 | 98.3 | 94.7 | 78.6 |
| Comp. Example 3 | 3.2 | 2.2 | 1.0 |
| Borderline Solution | 84.5 | 71.3 | 40.4 |
| Solid Beam | 0 | 0 | 0 |

COMPARATIVE EXAMPLE 4

Comparative Example 4 was identical to Example 1, except that the 3% of hydrogen peroxide was replaced with an equal amount of deionized water.

COMPARATIVE EXAMPLE 5

Comparative Example 5 was identical to Example 1, except that (a) the 3 wt. % hydrogen peroxide was replaced with an equal amount of deionized water; and (b) no fluorinated hydrocarbon was used.

Comparative Examples 4 and 5 were tested for turbidity in the manner described above. The results are shown in Table 2.

TABLE 2

| | Wavelength | | |
|---|---|---|---|
| | 800 nm | 600 nm | 400 nm |
| Deionized Water | 100 | 100 | 100 |
| Comp. Example 4 | 99.2 | 97.6 | 88.7 |
| Comp. Example 5 | 99.8 | 99.7 | 97.5 |
| Solid Beam | 0 | 0 | 0 |

As shown by the foregoing, in the presence of hydrogen peroxide, the use of the solvent of the present invention, in combination with each of a copolymer soil resist and a fluorinated hydrocarbon soil resist (Example 1) provides an extremely clear solution. The data corresponding to Comparative Example 2 demonstrates that a solution having the clarity of Example 1 cannot be formed with HEXYL CELLOSOLVE as the solvent. Further, with HEXYL CELLOSOLVE as the solvent, the combined use of the fluorinated hydrocarbon soil resist and the polymeric or copolymeric soil resist formed a turbid, unstable and commercially unacceptable solution.

A comparison between Comparative Examples 4 and 5 shows that the combined use of a polymeric or copolymeric soil resist, a fluorinated hydrocarbon soil resist and a solvent of the present invention, but no hydrogen peroxide, results in only a slightly more turbid solution, as compared to a composition containing the polymeric copolymeric soil resist and no fluorinated hydrocarbon soil resist.

The peroxygen stability of the composition of Example 1 was tested by the following method:

A 5 g test sample of the composition of Example 1 was placed in a 250 mL Erlenmeyer flask. 50 mL deionized water and 10 mL of 25% sulfuric acid were then pipetted into the flask to form a mixture. The resulting mixture was titrated with an amount of 0.5N potassium permanganate sufficient to achieve a pink endpoint that persists for at least 30 seconds. The procedure was then repeated using a blank sample, and the amount of remaining hydrogen peroxide was determined according to the following formula:

$$\%\ \text{Hydrogen Peroxide} = \frac{(V_1 - V_2) \times N \times 1.701}{W}$$

wherein:

$V_1$=mL of potassium permanganate required by sample;

$V_2$=mL of potassium permanganate required by blank;

N=normality of potassium permanganate solution; and

W=weight of sample (in grams).

Based on the % hydrogen peroxide remaining, the stability of the composition of Example 1 was determined after one week and one month at room temperature(25° C.) and at temperatures of 38° C. and 45° C. The samples were also visually evaluated after one month, and after three freeze(-4° C.)/thaw cycles. The results of the stability test are shown in Table 3.

TABLE 3

| | % Hydrogen Peroxide | | |
|---|---|---|---|
| | RT | 38° C. | 45° C. |
| 1 Week | 2.94 | 2.97 | 2.86 |
| 1 Month | 2.93 | 2.88 | 2.81 |

The above data demonstrates the excellent stability (only about a 6% loss of $H_2O_2$ after one month at 45° C.) of the compositions of the present invention. Visual inspection of the one month old sample confirmed that the sample remained visually acceptable. After three freeze/thaw cycles, the solution remained clear with no visible phase separation or precipitation.

The present invention has been described with particular reference to the preferred forms thereof. It will be obvious to one of ordinary skill in the art that various changes and modifications may be made therein without departing from the spirit and scope of the present invention as defined by the following claims.

What is claimed is:

1. An aqueous composition for cleaning fabrics and carpets, and inhibiting the resoiling of fabrics and carpets, said composition comprising:

(a) from about 0.1 to about 5.0 wt. % of a solvent selected from the group consisting of isopropanol, propylene glycol methyl ether, dipropylene glycol methyl ether, and mixtures thereof;

(b) from about 0.2 to about 6.0 wt. % of a peroxygen compound;

(c) from about 0.2 to about 6.0 wt. % of a surfactant;

(d) from about 0.1 to about 4.0 wt. % of a first soil resist selected from the group consisting of a polymer, a copolymer and a mixture thereof; and (e) from about 0.001 to about 2.0 wt. % of a perfluroralkyl compound which is a second soil resist;

wherein said composition has a pH of about 5.5 to about 7.0.

2. The composition of claim 1, wherein said first soil resist is a polymer derived from a monomer selected from the group consisting of acrylic acid, methacrylic acid, methacrylate, methylmethacrylate, ethyl acrylate and maleic acid, and wherein the acrylic acid monomer can be in the form of either an acrylic acid or a water soluble salt of acrylic acid.

3. The composition of claim 1, wherein said first soil resist is a copolymer derived from (I) a copolymer consisting of at least two monomers selected from the group consisting of acrylic acid, methacrylic acid, methacrylate; methylmethacrylate, ethyl acrylate and maleic acid; or (II) a copolymer of (a) an olefin and (b) at least one monomer selected from the group consisting of acrylic acid, methacrylic acid, methacrylate, methylmethacrylate, ethyl acrylate and maleic acid; and wherein the acrylic acid monomer can be in the form of either an acrylic acid or a water soluble salt of acrylic acid.

4. The composition of claim 1, wherein said solvent includes a mixture of propylene glycol methyl ether and dipropylene glycol methyl ether.

5. The composition of claim 4, wherein said mixture of propylene glycol methyl ether and dipropylene glycol methyl ether is about from 0.1 to about 3.0 wt. % of said composition.

6. The composition of claim 4, wherein said mixture of propylene glycol methyl ether and dipropylene glycol methyl ether is from about 1.5 to about 2.5 wt. % of said composition.

7. The composition of claim 1, wherein said peroxygen compound is hydrogen peroxide.

8. The composition of claim 7, wherein said hydrogen peroxide is from about 1.0 to about 4.0 wt. % of said composition.

9. The composition of claim 7, wherein said hydrogen peroxide is from about 2.5 to about 3.5 wt. % of said composition.

10. The composition of claim 1, wherein said surfactant is selected from the group consisting of an anionic surfactant, a nonionic surfactant, and a mixture thereof.

11. The composition of claim 10, wherein said surfactant is a mixture of an anionic surfactant and a nonionic surfactant.

12. The composition of claim 11, wherein said mixture of said anionic surfactant and said nonionic surfactant is from about 0.5 to about 3.0 wt. % of said composition.

13. The composition of claim 11, wherein said anionic surfactant is a combination of sodium lauryl sulfate and sodium lauroyl sarcosinate, and wherein said nonionic surfactant is a combination of lauramine oxide and a $C_{11}$–$C_{15}$ secondary alcohol ethoxylate.

14. The composition of claim 11, wherein said mixture of the anionic surfactant and the nonionic surfactant is from about 1.0 to about 1.5 wt. % of said composition.

15. The composition of claim 3, wherein said monomer includes acrylic acid.

16. The composition of claim 1, wherein said copolymer includes monomers of acrylic acid, methylmethacrylate and styrene.

17. The composition of claim 16, wherein said copolymer of said first soil resist is from about 0.3 to about 0.9 wt. % of said composition.

18. The composition of claim 1, further comprising at least one additional component selected from the group consisting of a stabilizer/pH controller, a preservative and a fragrance.

19. The composition of claim 18, wherein said at least one additional component is a stabilizer/pH controller.

20. The composition of claim 18, wherein said at least one additional component is a preservative.

21. The composition of claim 19, wherein said stabilizer/pH controller is 1-hydroxyethylidene-1,1-diphosphonic acid.

22. The composition of claim 20, wherein said preservative is hexahydro-1,3,5-tris(2-hydroxyethyl)-s-triazine.

23. An aqueous composition for cleaning fabrics and carpets, said composition comprising:

(a) from about 0.1 to about 5.0 wt. % of a solvent selected from the group consisting of isopropanol, propylene glycol methyl ether, dipropylene glycol methyl ether, and mixtures thereof;

(b) from about 0.2 to about 6.0 wt. % of a peroxygen compound;

(c) from about 0.2 to about 6.0 wt. % of a surfactant; and (d) from about 0.1 to about 4.0 wt. % of a first soil resist selected from the group consisting of a polymer, a copolymer and a mixture thereof; and (e) from about 0.001 to about 2.0 wt. % of a perfluoroalkyl compound which is a second soil resist.

* * * * *